US006233848B1

(12) United States Patent
Bonaventure

(10) Patent No.: US 6,233,848 B1
(45) **Date of Patent: *May 22, 2001**

(54) SPORTS BOOT HAVING A RIGID FRAME AND COVER

(75) Inventor: Laurent Bonaventure, Cran-Gevrier (FR)

(73) Assignee: Salomon S.A., Metz-Tessy (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/021,862

(22) Filed: Feb. 11, 1998

(30) Foreign Application Priority Data

Feb. 19, 1997 (FR) ..... 97 02139
Oct. 30, 1997 (FR) ..... 97 13887

(51) Int. Cl.[7] ..... A43B 7/20; A43B 5/04

(52) U.S. Cl. ..... 36/89; 36/92; 36/107; 36/108; 36/115; 36/117.6; 280/11.22

(58) Field of Search ..... 36/97, 115, 118.2, 36/119.1, 117.1, 100, 101, 89, 92, 107, 108, 117.6; 280/11.22

(56) References Cited

U.S. PATENT DOCUMENTS 757,816 * 4/1904 Krieger .
1,205,206 * 11/1916 Hofmeister .
1,546,551 * 7/1925 Petri .
1,986,580 * 1/1935 Johnson .
2,153,968 * 4/1939 Loufbahn ..... 36/101 X
2,444,428 * 7/1948 Carrier .
2,617,207 * 11/1952 Jennett .
4,268,981 * 5/1981 Olivieri .
4,825,566 * 5/1989 Sartor ..... 36/117.9 X
4,869,001 * 9/1989 Brown .
4,949,479 * 8/1990 Ottieri ..... 36/117.1 X
5,437,466 8/1995 Meibock et al. ..... 280/11.22
5,498,033 * 3/1996 Hoshizaki et al. .
5,499,461 * 3/1996 Danezin et al. ..... 36/118.2 X
5,588,228 * 12/1996 Foscaro et al. ..... 36/118.2
5,664,344 9/1997 Marmonier ..... 36/118.2
5,678,330 * 10/1997 Van Dyke et al. .
5,768,807 * 6/1998 Caeran et al. .

FOREIGN PATENT DOCUMENTS 0646334 4/1995 (EP) .
0740908 11/1996 (EP) .
0753269 1/1997 (EP) .
WO 95/15094 6/1995 (WO) .

* cited by examiner

*Primary Examiner*—Ted Kavanaugh
(74) *Attorney, Agent, or Firm*—Greenblum & Bernstein, P.L.C.

(57) ABSTRACT

Boot of the type including a rigid frame including of at least one rigid sole portion and a heel reinforcement affixed to the sole, and including an upper that is at least partially flexible, wherein it includes a part forming a cover that takes the shape of at least a portion of the rigid frame and is intended to is pulled on over at least the portion of the frame, the cover being equipped with connecting elements to the rigid frame. Advantageously, the boot includes a liner affixed to the part forming the cover, the outer wall of the liner constituting the inner wall of the part forming the cover.

20 Claims, 8 Drawing Sheets

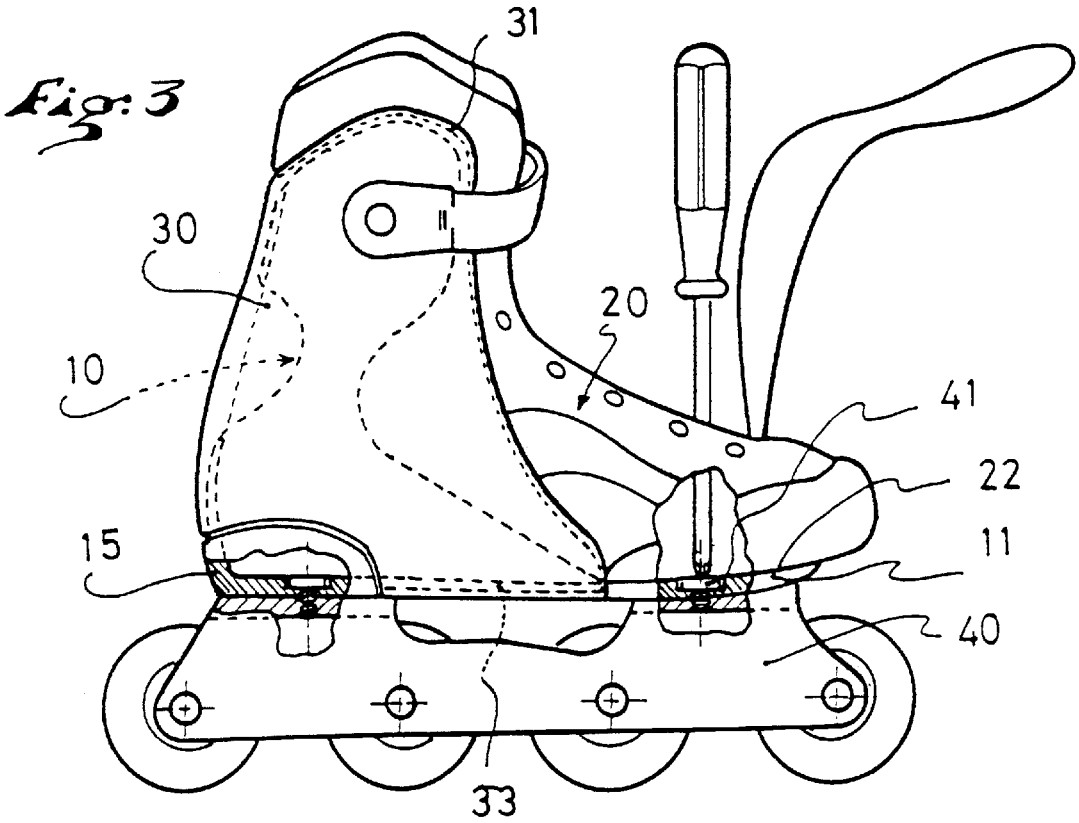
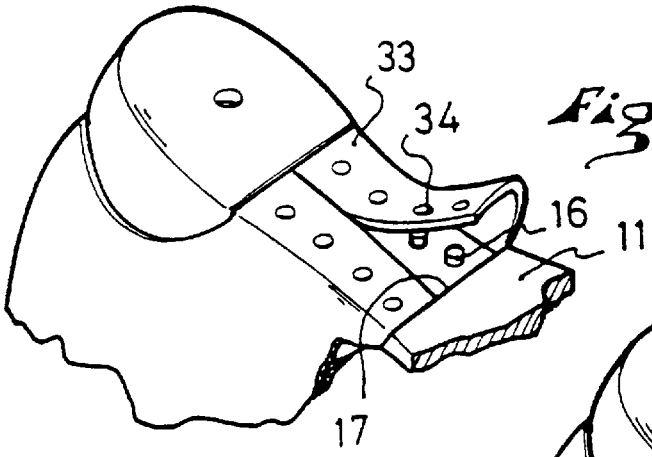
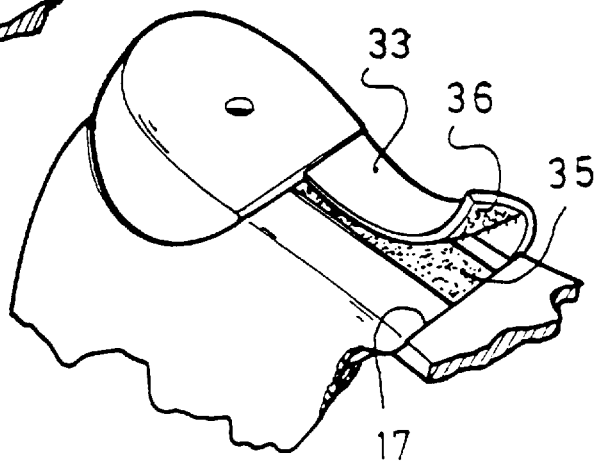
Fig: 5

Fig: 13
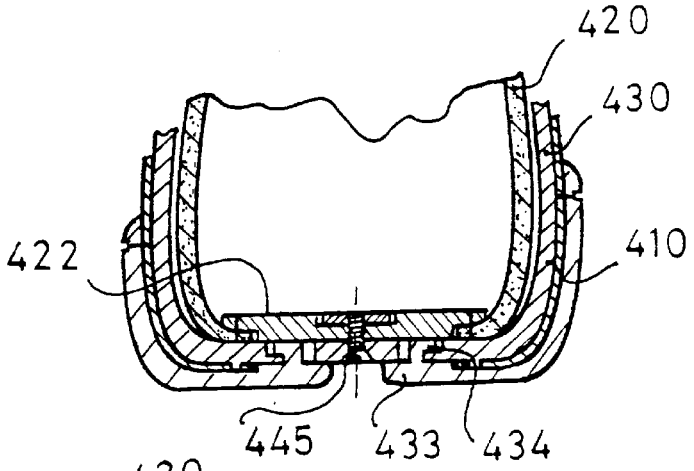
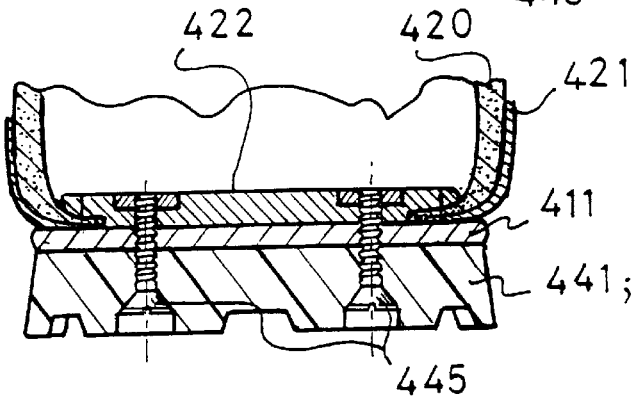
Fig: 16
Fig: 17
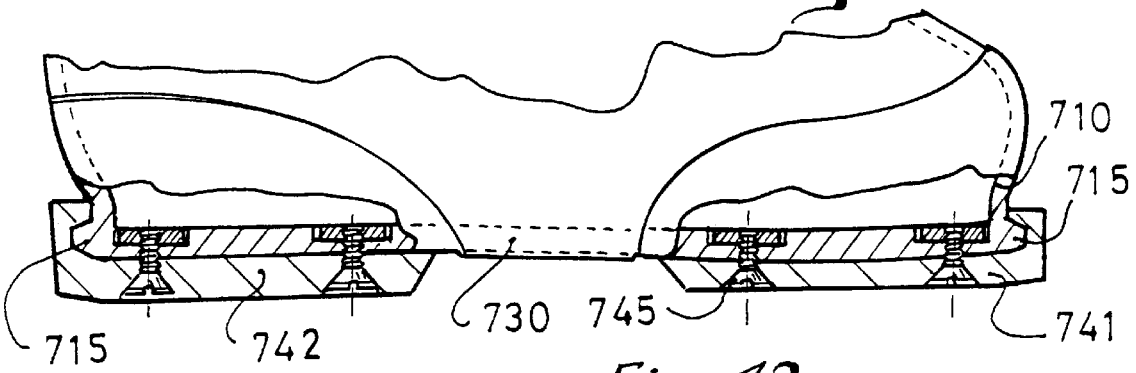
Fig: 18
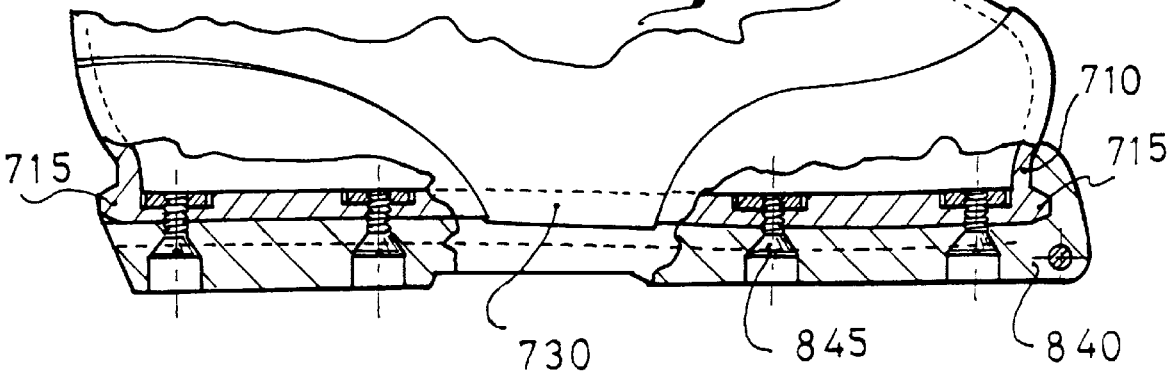

SPORTS BOOT HAVING A RIGID FRAME AND COVER

BACKGROUND OF THE INVENTION

1. Field of the Invention

The instant invention is related to a sports boot and is especially intended for glide sports such as roller skating, in-line roller skating, ice skating, or snowboarding, or, in other words, a boot that has to simultaneously fulfill the contradictory requirements of retention as well as flexibility for the ankle in pre-determined directions.

2. Description of Background and Relevant Information

For skating, walking, or hiking, it is desirable to have ankle retention in the transverse direction, as well as a certain pivoting or bending freedom in the longitudinal direction, at least towards the front.

In snowboarding and in certain types of in-line roller skating, it is desirable, on the contrary, to have a certain possibility for bending the ankle in the transverse direction, whereas bending in the longitudinal direction is more limited.

In order to overcome these problems, these boots generally include a rigid frame, constituted by at least one rigid sole portion associated to a heel reinforcement affixed to said sole.

Such boots also include, as the case may be, a stiff collar intended to surround the user's ankle so as to maintain such ankle in the transverse direction.

Boots for in-line roller skating are generally constituted as a plastic shell that includes a shell base surrounding the user's foot and a collar journalled on the shell base, as well as a detachable liner arranged within the shell.

Such a rigid, massive, and visible frame provides the boot with a stiff, hot, and uncomfortable appearance which one wishes to avoid.

Some boots, as disclosed in U.S. Pat. No. 5,437,466, are constituted of an upper made of a flexible material and are manufactured according to techniques that are known in flexible sports boots and they are adhered inside a rigid, external frame.

The disadvantage of such a construction is that the external frame remains visible and assembly by adhesion of the flexible upper to the rigid, external frame is delicate and cannot be detached. The same comment also applies to sports boots meant for walking that comprise so-called "shell" soles.

In addition, the assembly of a flexible structure to a rigid structure by means of other traditional methods such as stitching is also difficult to obtain due to the differences in hardness between the materials.

Other skating boots having a "soft", i.e., flexible, external appearance are constituted by a rigid structure and a flexible upper connected together by a method known as injection on the upper which hides the rigid structure. This type of technique is extremely complex and expensive, and in addition, it cannot be disassembled.

Furthermore, the majority of known sports boots are each specific to a given sport and they cannot be used or transformed easily with a view to being used for another sport.

SUMMARY OF THE INVENTION

It is an object of the instant invention to overcome the disadvantages cited hereinabove and to provide a boot structure that combines the aesthetic and comfort-related advantages of a flexible boot with the stiffness and ankle retention advantages of a rigid boot.

It is also an object of the instant invention to provide a new method for mounting and assembling a sports boot having a rigid frame, the method being quicker and less expensive than the traditional assembly methods, and also providing a geater multi-functional usage to the boot.

This object is achieved in the boot according to the invention which is of the type that is constituted by at least one rigid sole portion and a heel reinforcement affixed to the sole, as well as an upper that is at least partially flexible, due to the fact that it includes a part forming a cover that take the shape of at least one part of the rigid frame and is intended to be pulled up over at least the part of the frame, the cover being equipped with detachable or fixed means for connecting it to the rigid frame.

The part forming the cover thus provides the boot with the desired soft appearance, while at the same time, it is compatible with a rigid frame.

Further, such a solution is extremely easy and inexpensive because it avoids all the connection problems involving adhesion or stitching and remedies the problems of connecting a flexible part to a rigid part, since the shape of the enveloping cover is itself used as the connection.

Finally, it allows for a certain standardization of products, since these products can have a common rigid frame and an external appearance that is totally different due to the use of parts forming different covers, or conversely, by virtue of the part forming the cover, the products can have similar appearances even though the rigid frames have different characteristics.

In all cases, the connection between the cover and the rigid frame can be either detachable, so that it can be removed, or fixed, in which case the cover could no longer be removed.

The detachability of the part forming the cover makes it very easy to change in case of wear and tear, or if one wishes to change the appearance of the product.

According to an especially advantageous embodiment, the boot includes a flexible liner and this liner is affixed to the part forming the cover, the outer wall of the liner thus constituting the inner wall of the part forming the cover.

Such a construction allows one to affix the liner to the rigid frame via the part forming the cover, and thus allows one to guarantee a certain fixedness of the liner with respect to the frame.

BRIEF DESCRIPTION OF THE DRAWINGS

The invention will be better understood and other characteristics thereof will become more apparent from the description that follows with reference to the annexed schematic drawings that illustrate, as non-restrictive examples, several embodiments and wherein:

FIG. 3 is a view similar to FIGS. 1 and 2, showing the final assembly of a boot according to the invention to a skating chassis;

FIG. 4 is a detailed perspective view showing the connection of the part forming the cover to the rigid frame;

FIG. 5 is a view similar to FIG. 4 according to another embodiment;

FIG. 13 is a sectional view taken along line XIII—XIII of FIG. 12;

FIG. 16 is a sectional view taken along line XVI—XVI of FIG. 12;

Figure 19:
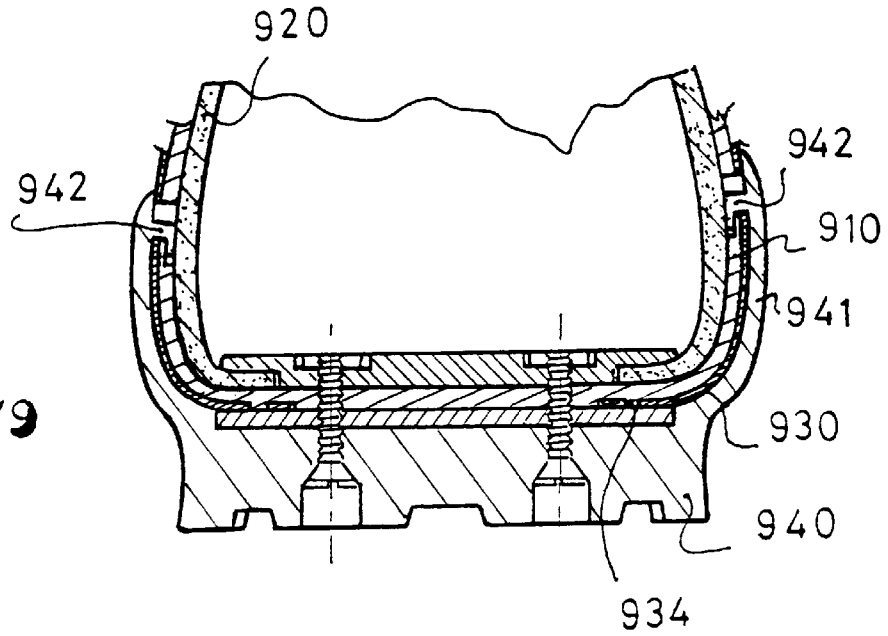
Figure 20:
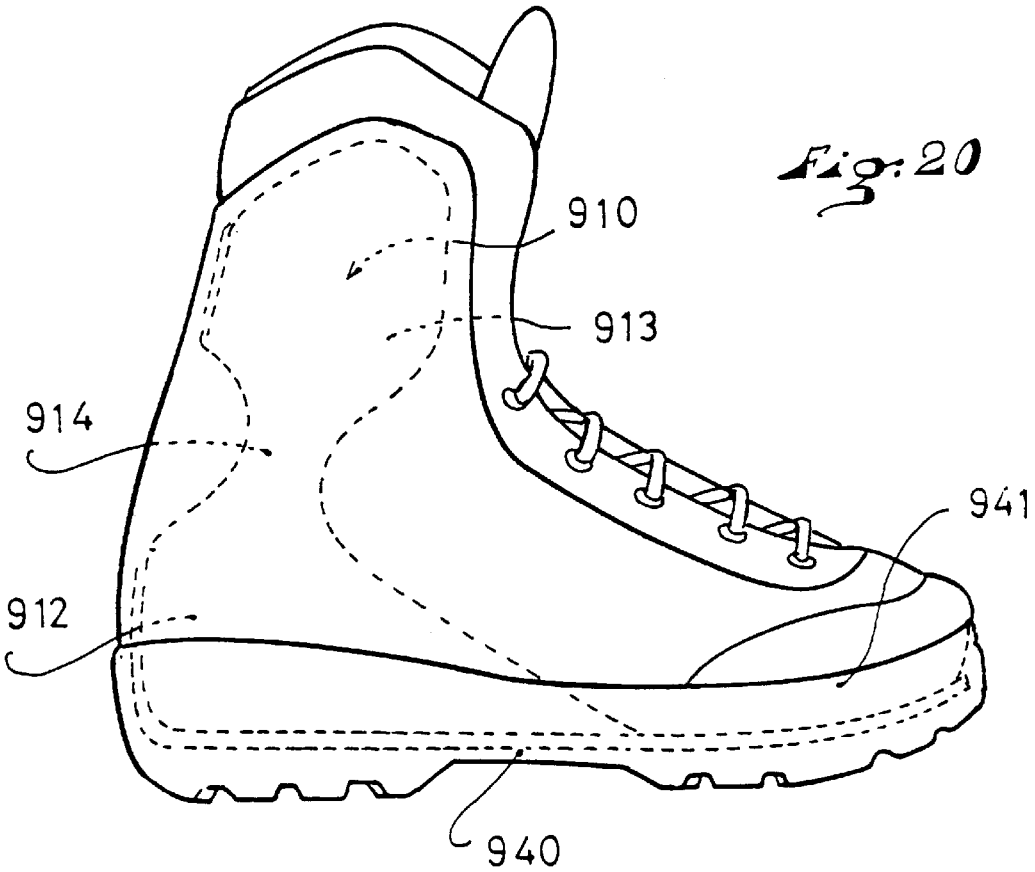

PIG. 17 is a partial longitudinal sectional view of a boot according to an example where it finds an application in downhill ski boots;

FIG. 18 is a view similar to FIG. 17 according to another example of application;

FIG. 19 is a view similar to FIG. 16 according to another embodiment; and FIG. 20 is a side view of the boot of FIG. 19.

DETAILED DESCRIPTION OF THE INVENTION

Figure 1:
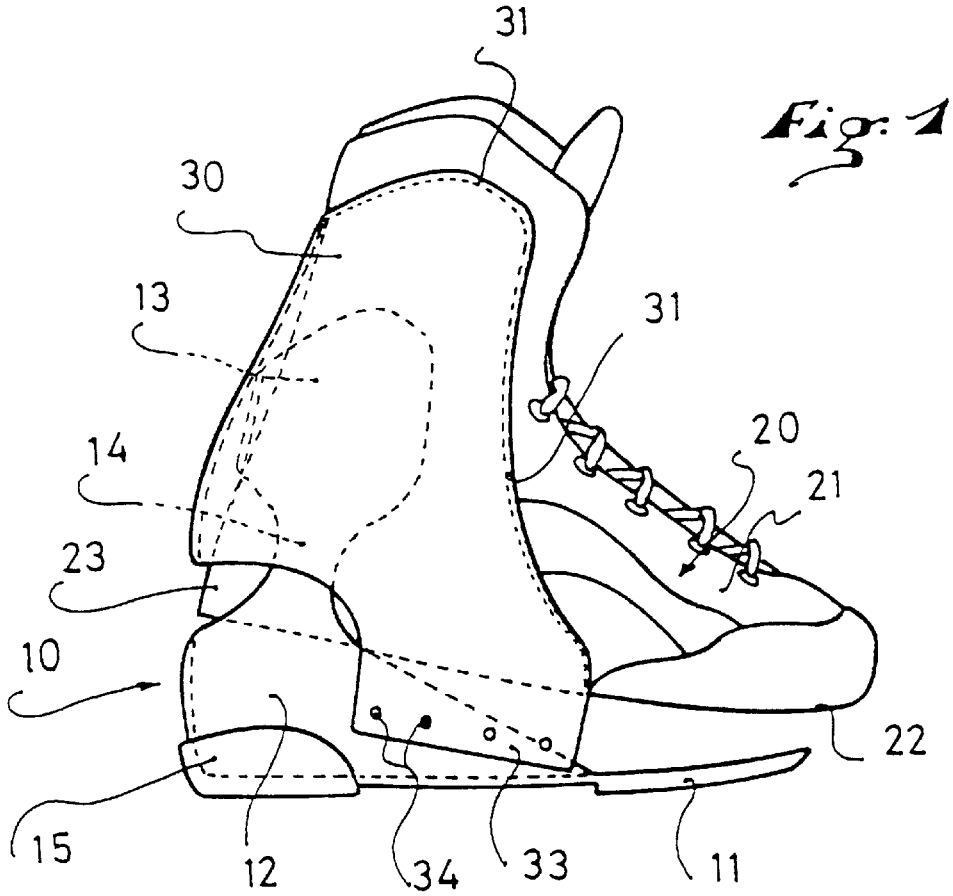
FIG. 1 is a side view of a boot as per the invention wherein the part forming the cover is in the process of being positioned.
Figure 2:
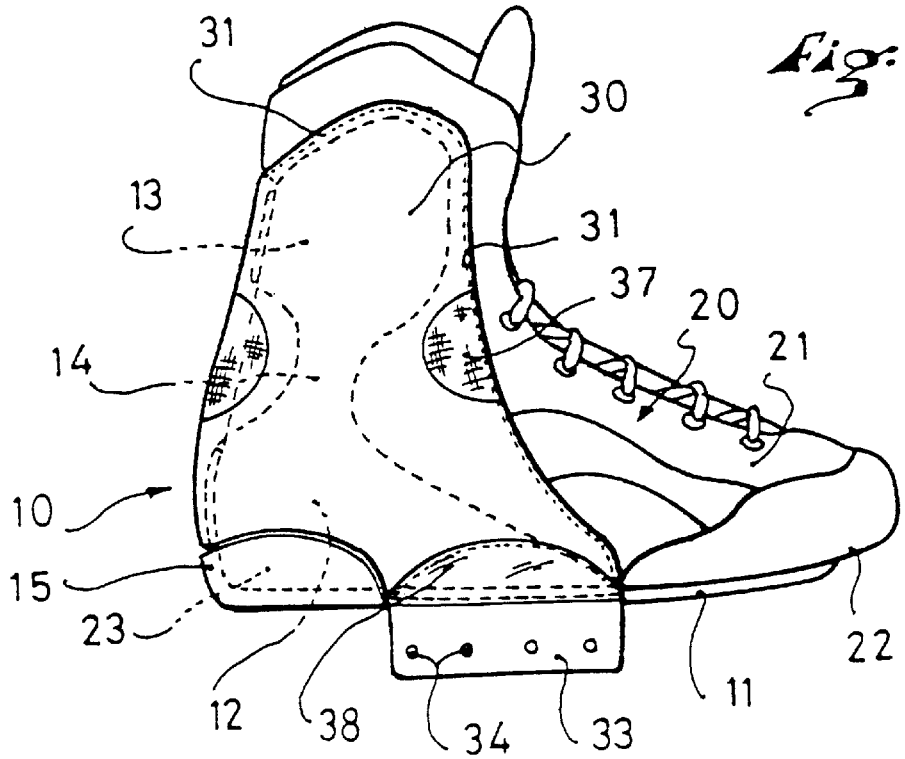
FIG. 2 is a view similar to FIG. 1 and shows the postioning of the part forming the cover on the rigid frame.

As can be seen especially in FIGS. 1 through 3, the boot, according to the invention, according to a first embodiment, includes a rigid frame 10, a flexible liner 20 and a part forming the cover 30 connected to the liner 20.

The rigid frame 10 includes a rigid sole 11 which is provided at the rear of a heel reinforcement 12, which is also rigid and a part 13 in the form of a collar, intended to extend along the user's ankle and connected to the heel reinforcement 12, on each side, by a connecting zone, shaped like a leg 14 which is designed in such a way as to allow a certain amount of bending, in the longitudinal direction, of the boot. Depending on the type of boot, the sole 11 may be only partially rigid, for example, in order to enable walking.

In addition, the heel reinforcement 12 has, in the area of its lower part, a peripheral shoulder 15 that projects with respect to the surface of the reinforcement 12.

The extent to which the shoulder 15 projects with respect to the reinforcement surface corresponds substantially to a wall thickness of the part forming the cover.

The flexible liner 20 is constituted, in a known manner, of a flexible upper 21 assembled by stitching and mounted on an insole 22.

The part forming the cover 30, in the present case, includes a flexible wall whose contours correspond substantially to the contours of the part 12, 13, 14 of the frame to be covered, and it is assembled to the flexible liner 20 via its upper and lateral edges by means of a stitching 31. In the illustrated embodiment, the laterally spaced edges provide a forwardly facing opening from which the liner 20 projects.

This part 30 thus demarcates, along with the outer wall 23 of the liner, a part forming a cover, that is open at the base and capable of being pulled onto the rigid frame 10.

At its lower end, the part forming the cover 30 is also equipped, on each side, with a fastener 33, provided with attachment(s) or connection(s) 34. In the embodiment represented in FIGS. 1 through 3, these connections 34 are constituted by holes. In addition, the cover 30 can include, in the front/rear bending zones of the ankle. zones that are more flexible or elastic 37, as well as reinforcements 38 in the more exposed zones, such as for example, at the level of the sole.

The final assembly of a boot according to the invention is illustrated in FIGS. 1 through 3.

Initially, as is shown in FIG. 1, cover 30 is pulled onto the rigid frame 10 until the liner 20 comes into support against the upper surface of sole 11. At this time, the rear lower edge of the cover 30 is in support against the shoulder 15 of the heel reinforcement. In fact, this shoulder 15 has a dual role, i.e., to constitute an abutment for the correct positioning of the cover 30, and to form a continuous surface with the wall of the cover. This shoulder can also be designed in such a way as to simulate a sole of a flexible boot.

Thereafter, all that is required is to fold back the fasteners 33 beneath the rigid sole 11 and to fix them there in order to complete the assembly of the liner 20 and the cover 30 to the rigid frame 10.

As can be seen from FIG. 4, the connection of the fasteners 33 to the rigid sole 11 can be done by means of pins 16 provided on the lower surface of the sole and capable of being introduced into the associated holes 34 of the fasteners 33.

The connection can also be obtained by means of complementary self-gripping members, respectively 35, 36, such as hook and loop fasteners (VELCRO, e.g.) provided on the fasteners 33 as shown in FIG. 5.

In both cases, these connecting devices 33, 34; 35, 36 are detachable and thus allow the cover to be replaced easily in case of wear or if one wants to change the appearance of the boot. The connecting devices can also be provided to be fixed and non-detachable if the detaching capacity of the cover is not desired.

As illustrated in FIGS. 4 and 5, a recess 17 can also be provided in the area of the lower surface of sole 11, so as to receive and house the fasteners 33 without creating any overthicknesses.

The boot thus completed can then be assembled to a chassis 40 of an item of sports equipment (such as a roller skate, e.g.) by any known means, such as rivets or even screws 41 extending through the insole 22, the sole 11 of the rigid frame, and being screwed into the chassis, as illustrated in FIG. 3. The advantage of such an assembly is that it does not necessitate any heavy assembly means, such as adhesives. Moreover, the assembly of the boot to the chassis also simultaneously allows the actual final assembly of the boot to be completed, i.e., of the rigid frame thereof with the upper, and thus saves an additional assembly operation.

Furthermore, such a construction has the advantage that the part forming the cover 30 also ensures an additional retention for the liner portion 20 with respect to the chassis.

Figure 6:
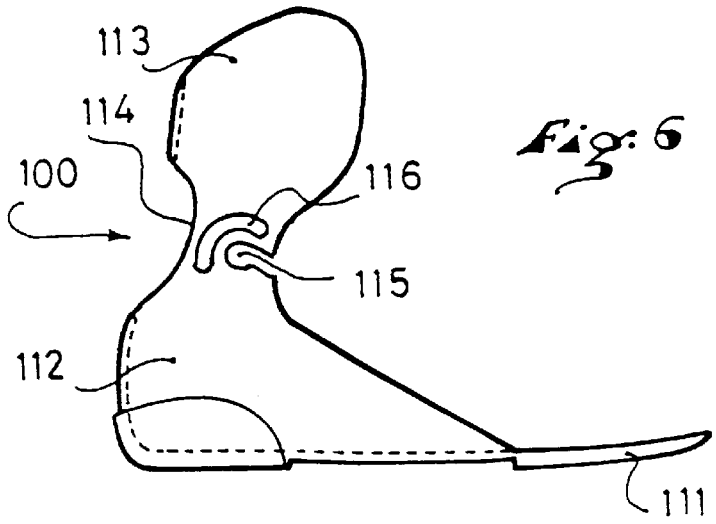
FIGS. 6 and 7 are side views showing various embodiment examples of the rigid frame.
Figure 7:
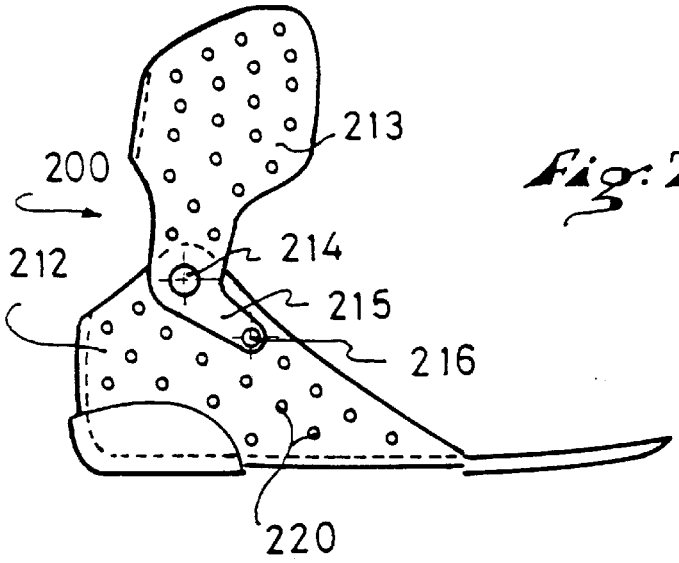

FIGS. 6 and 7 show other embodiments of a rigid frame, respectively 100, 200.

In the case of FIG. 6, the rigid frame 100 is, similarly to the frame 10, constituted of a sole 111 and a collar 113 connected to the heel reinforcement 112 of sole 11 by two lateral connecting zones in the form of a leg 114, each equipped with a scallop 115 and a curvilinear slot 116 so as to facilitate longitudinal bending in the rear to front direction.

If needed, shock-absorbing or resilient means can be positioned inside the scallops and slots 115, 116 so as to provide shock absorption or a certain amount of elasticity during bending.

In the example of FIG. 7, the collar 213 is constituted by an independent element journalled at 214 on the heel reinforcement 212. In addition, the collar is extended on each side by a fastener 215, affixed at 216 on the heel reinforcement 212 and provides an elastic return energy in case of frontward bending.

Other connecting and/or journal means or means for energizing the collar on the reinforcement could be envisioned without leaving the scope of the instant invention.

Similarly, the journal of the collar on the reinforcement along a substantially transverse axis 214 could be replaced by a journal along a longitudinal axis, so that it finds an application in snowboarding, for example, such that the favored pivoting or bending directions of the collar become transverse.

Other embodiments for the elastic biasing of the collar can also be envisioned.

In the case of FIG. 7, the rigid frame 200 is equipped with multiple perforations 220 in an effort to make it lighter.

FIGS. 8 through 11 illustrate yet another embodiment wherein the cover 330 is independent of the liner 320, and due to this fact, it includes an inner wall 331 and an outer wall 332 that cover the entirety of the upper portion of the rigid frame 310.

Figure 8:
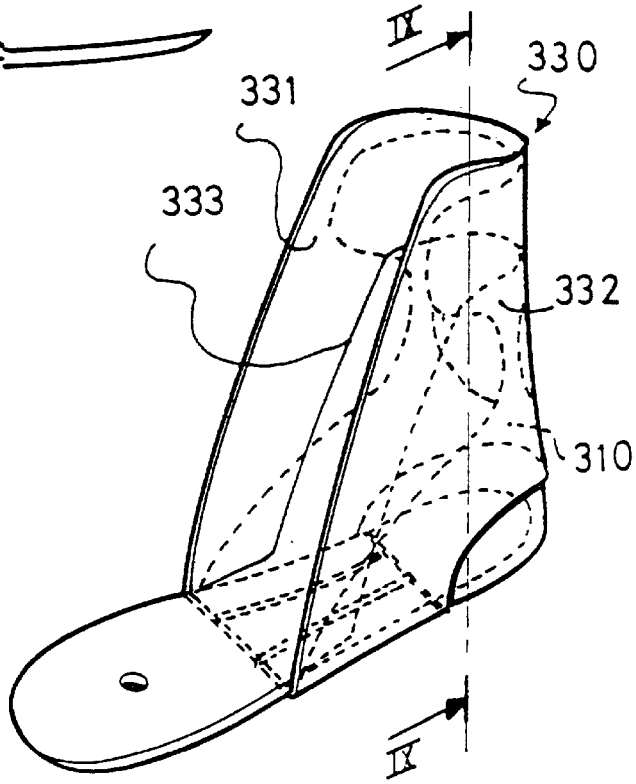
FIG. 8 is a perspective view of a rigid frame covered with the part forming the cover as per another embodiment.
Figure 9:
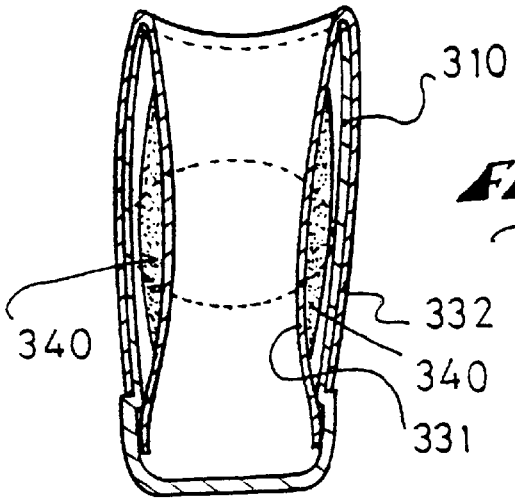
FIG. 9 is a sectional view taken along line IX—IX of FIG. 8.
Figure 10:
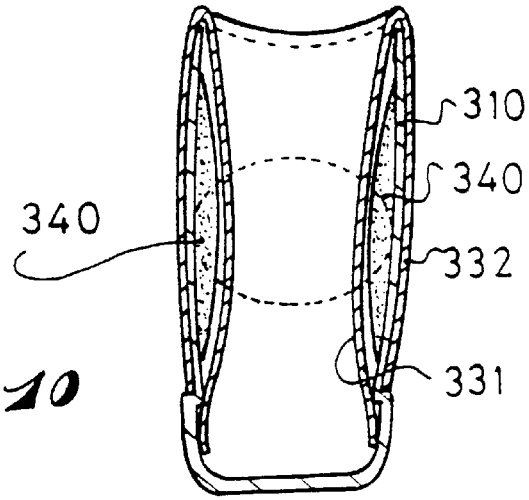
FIG. 10 is a view similar to FIG. 9 according to another embodiment.
Figure 11:
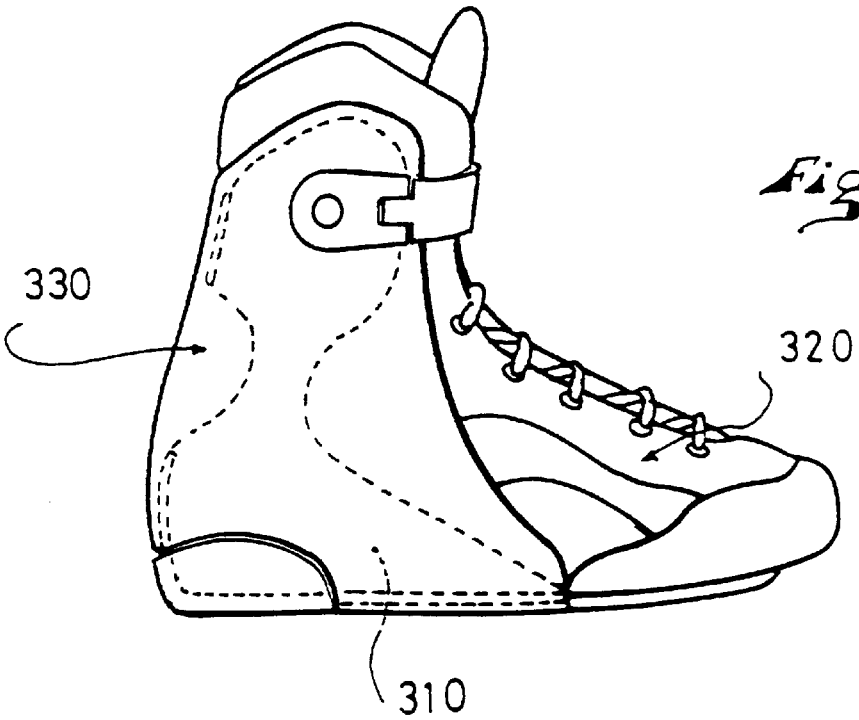
FIG. 11 is a side view of a boot equipped with the part forming the cover according to FIG. 8.

In this case, the inner wall 331 can come down to the level of the sole, as represented in FIGS. 9 and 10, or inversely, be limited to a certain covering zone 333 bordering the upper edge of the rigid frame, as represented in FIG. 8.

The assembly and affixing of such a cover 330 are obtained exactly as has been described previously.

Furthermore, FIGS. 9 and 10 illustrate the possibility of interposing an additional foam cushion 340 between the inner wall 331 of the cover 330 and the rigid frame 310.

In the example of FIG. 9, the cushion 340 is connected to the inner wall 331 of the cover, for example, by means of self-gripping devices, whereas in the example of FIG. 10, the cushion 340 is connected to the rigid frame.

Such a cushion 340 provides additional comfort and spacing and, in addition, it can be detached easily.

FIGS. 12 through 20 illustrate the application of the instant invention to sports boots meant for walking or having a multi-functional usage. In each case, similar or equivalent elements have been designated by the same reference numerals increased by 100.

Figure 12:
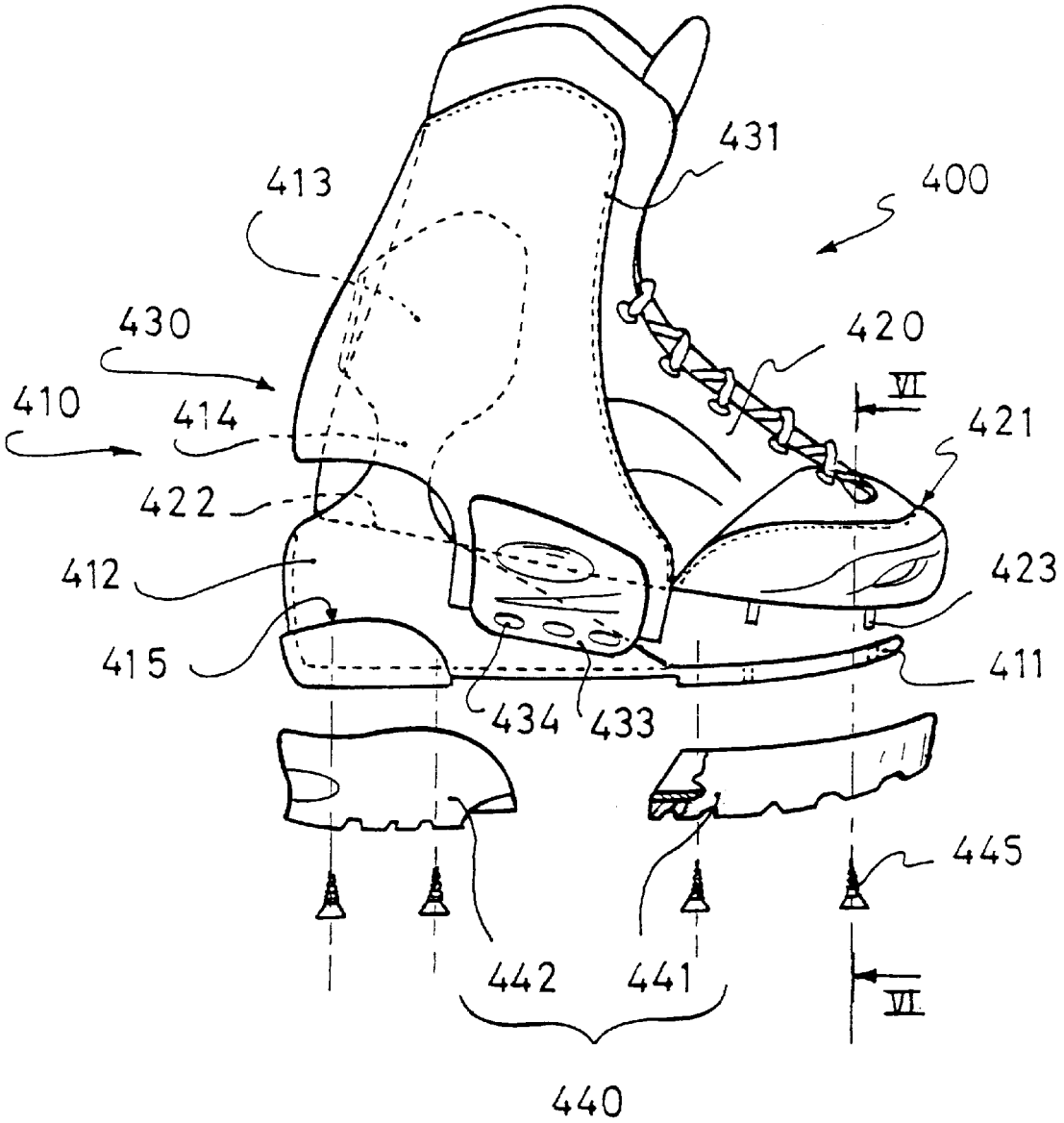
FIG. 12 is a view similar to FIG. 1 showing how the invention can find an application in walking boots.

Firstly, FIG. 12 shows a walking boot 400 constituted by a rigid frame 410, a flexible upper 420 including a cover portion 430 and an outer sole 440.

The rigid frame 410, in the example represented, is substantially identical to the frame represented in FIGS. 1 through 3, and is constituted by a rigid sole portion 411, equipped at the rear with a heel reinforcement 412 which is also rigid, and a part 413 shaped like a collar and intended to surround the user's ankle; it is connected to the heel reinforcement 412 an each side via a flexible connecting zone 414 intended to allow a certain bending along the longitudinal direction of the boot.

A peripheral shoulder 415 is also designed to project on the reinforcement 412.

The upper 420 is a flexible upper, preferably of the type that is assembled on the mold by means of an insole 422. In the example represented, the flexible upper 420 is equipped at the front with a relatively rigid joining piece 421 that is part of the insole 422, and equipped with assembly pins 423, as will be explained hereinafter.

The part forming the cover 430 is constituted of a flexible wall, whose contour corresponds to that of parts 412, 413, 414 of the frame to be covered, and which is assembled to the flexible upper 420 by its upper and lateral edges by means of stitching 431.

As was the case previously, this part forming the cover 430 is equipped on each side with a fastener 433 bearing the attachment(s) or connection(s) 434 similar to the ones that have already been described for example in FIG. 4.

Finally, the outer sole 440, which in this case replaces the chassis of the previous embodiments, is a walking sole, constituted of two parts—front and rear, 441 and 442, respectively.

The final assembly is obtained in exactly the same way as was described in connection with FIGS. 1 through 11, and has been represented schematically in FIGS. 13 through 16.

First, the cover 430 is pulled over the rigid frame 410 until it comes into support against the shoulder 415 of the reinforcement, the pins 423 are positioned in the associated holes of the sole 411, then the fasteners are folded back and affixed beneath the rigid sole of the frame by the holding means 434 and the assembly is completed by screwing the screw 445 that crosses parts of the outer sole 441, 442, the sole 411 of the rigid frame and the insole 422.

Thus, and as was the case previously, the affixation of the part that is intended to be in contact with the bottom of the boot, or in other words, the walking sole 440, simultaneously results in the assembly of the flexible upper to the rigid frame and allows an additional assembly operation in the area of the upper of the boot itself to be saved.

This unique assembly operation results in a drastic reduction in the manufacturing costs.

In particular, the assembly of the wear sole to the rigid frame, without having to use an adhesion process, is especially advantageous due to the fact that there are differences in the hardnesses of the parts to be assembled, and the time required for drying the adhesive is saved.

It should be noted that the walking sole can also be obtained by molding with the rigid frame 410. In this case, the sole portion 411 of the frame and the walking sole portion could be equipped with appropriate housings for the affixing screws of the insole 422 so as to obtain the assembly of the flexible upper to the rigid frame 410.

Figure 14:
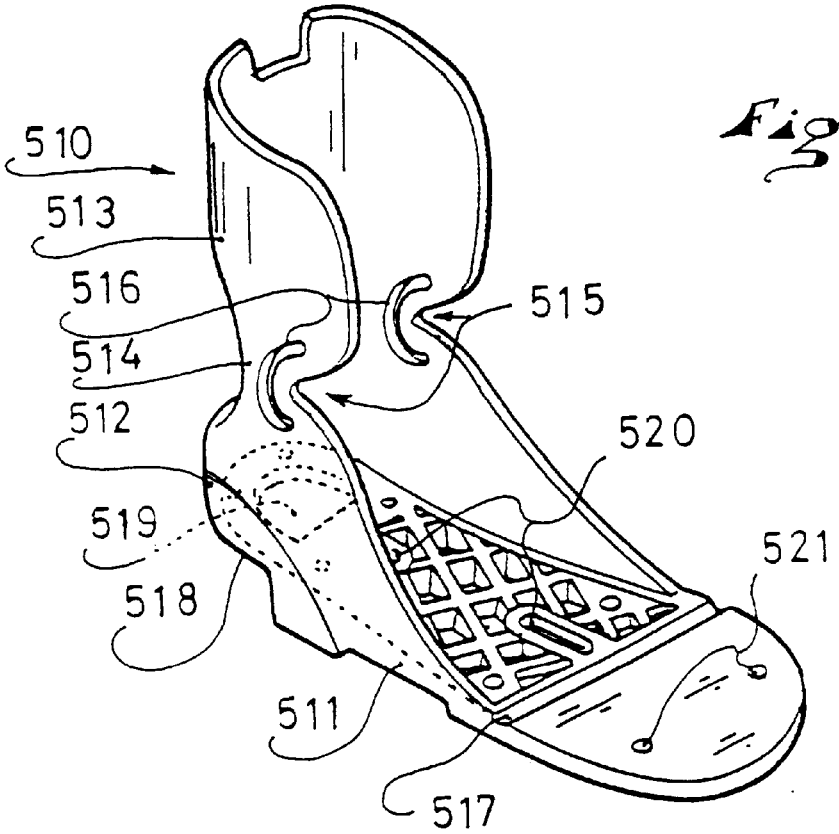
FIG. 14 is a perspective view of an embodiment of the rigid frame.
Figure 15:
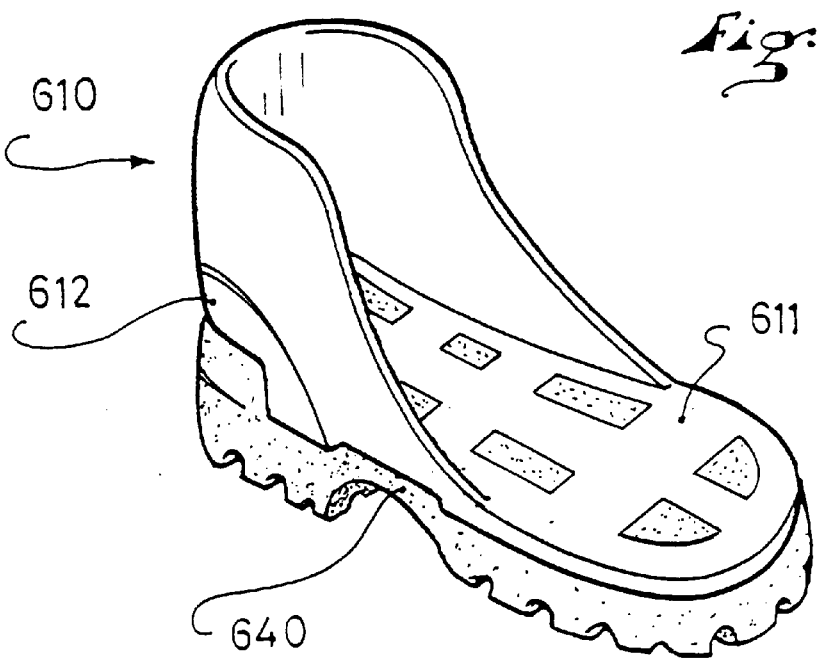
FIG. 15 is a view similar to FIG. 14 according to another embodiment.

The rigid frame 410 can be obtained in different ways, as has been shown especially in FIGS. 14 and 15.

Thus, in the examples shown in FIGS. 14 and 15, the frame 510 also comprises a sole portion 511 and a collar portion 513 connected by a flexible connecting zone 514 to a heel reinforcement 512.

However, the flexible connecting zone 514 has cut-outs 515 and slots 516 intended to increase the flexibility of such zone.

Similarly, the sole portion 511 has, towards the front and substantially in the metatarsal phalangian journal zone, a substantially transverse softening groove 517 intended to facilitate the bending of such sole portion while walking. This front zone can also be obtained in another way in order to facilitate bending and in particular, it can be made of multiple materials.

At the rear, the heel reinforcement can be hollowed in its lower portion at 518 so as to allow a shock absorbing material to be positioned between the sole portion 511 and the actual walking sole. The recess 518 can simply be peripheral, as represented in the drawing, or extend along the entire heel portion, by in fact incorporating the recess 519.

An additional recess 519 can also be provided in the sole portion 511 with the same aim of providing additional shock absorbing means.

Finally, the sole portion 511 can comprise several types of affixing holes, or in other words, oblong holes 520 arranged longitudinally for the binding of the assembly to a gliding member such as the chassis of a roller skate, and two series of three or four circular holes 521 for the affixing, via screws, of the waildng sole portions.

In this particular case, the boot can fulfill two very different functions. It can be used in glide sports by getting affixed to an adapted chassis, or it can be used for walking, or another sport, by affixing a walking sole or other adapted sole, to another type of sport. Consequently, we obtain here a boot that is completely multifunctional.

FIGS. 17 and 18 illustrate these last two alternatives.

Thus, FIG. 17 shows a boot, on the frame 710 of which has been assembled, by means of screws 745, two joining pieces 741, 742 of the downhill ski type, that are intended to transform such boot into a downhill ski boot, whereas FIG. 18 shows the same boot on the frame 710 of which is affixed, via screws 845, a sole 840 of the cross-country ski type, in order to transform it into a cross country ski boot.

In each of these cases, the rigid frame 710 comprises, at the front, and potentially at the rear, a peripheral projection 715 intended to facilitate the hooking of the attached sole portions, 741, 742, 840 respectively. In the case of FIG. 18, the sole 840 is made all in one piece and only gets hooked to the front projection 715. In addition, it covers the cover part 730.

FIG. 15 represents another embodiment where the frame 610 is "low" and does not comprise the collar part, but simply a heel reinforcement 612 extending in height substantially up to the level of the malleoli.

In the example represented in this FIG. 15, which could also be applied to other embodiments, the walking sole 640, made of an anti-skidding material, is duplicate molded on the sole portion 611 of the rigid frame with adapted crampon profiles.

Finally, FIGS. 19 and 20 illustrate a last embodiment wherein the walking sole 940 has a shape that rises along the flanks of the boot.

In this case, the sole 940 has lateral walls 941, equipped at their upper ends with clips 942 intended to be snapped into the corresponding housings provided on the rigid frame 910.

In order to obtain the perfect application of the lateral walls of the sole 941 against the flanks of the boot, they are preferably preformed according to a profile that is less wide than that of the rigid frame 910.

The instant invention is not limited to the specific embodiments described herein as non-restrictive examples, and it encompasses all equivalent embodiments thereof.

It can also find an application in all types of boots where the same problems or similar problems need to be resolved.

The instant application is based upon French priority patent applications No. 97 13887 filed on Oct. 30, 1997, and No. 97 02139 filed on Feb. 19, 1997, the disclosures of which are hereby expressly incorporated by reference thereto, and the priority of which is hereby claimed under 35 USC 119.

What is claimed is:

1. A boot comprising:

a sole;

an upper extending upwardly from the sole, at least a part of the upper being flexible;

a rigid frame comprising at least one rigid portion of the sole, the rigid frame further comprising a heel reinforcement extending upwardly from a rear of the sole;

a cover covering at least a portion of the rigid frame and extending around less than an entire periphery of the upper, at least a portion of the cover having a shape of at least the portion of the rigid frame; and a connecting arrangement securing the cover to the portion of the rigid frame, the connecting arrangement comprising a detachable hook and loop fastener, wherein the cover is connected externally to the rigid frame beneath a lower portion of the sole via the connecting arrangement.

2. A boot comprising:

a sole;

an upper extending upwardly from the sole, at least a part of the upper being flexible;

a rigid frame comprising at least one rigid portion of the sole, the rigid frame further comprising a heel reinforcement extending upwardly from a rear of the sole;

a cover covering at least a portion of the rigid frame and extending around less than an entire periphery of the upper, at least a portion of the cover having a shape of at least the portion of the rigid frame; and a connecting arrangement securing the cover to the portion of the rigid frame, the connecting arrangement comprising a detachable fastener which is readily detachable to allow a user to separate the upper from the rigid frame, wherein the cover is connected externally to the rigid frame beneath a lower portion of the sole via the connecting arrangement.

3. A boot comprising:

a liner comprising a sole and an upper extending upwardly from the sole adjacent a heel area of the liner, at least a part of the upper being flexible;

a rigid frame comprising at least a partially rigid sole having an external heel and a reinforcing wall extending upwardly from the at least partially rigid sole, the rigid frame being adapted to receive the liner and adapted to cover a portion of the upper adjacent the heel area of the liner; and a cover comprising side fastening edges, the cover surrounding at least a portion of the liner and being affixed to the liner, the cover and the liner being spaced apart and defining an opening adjacent the sole of the liner so as to receive the portion of the rigid frame;

wherein the cover covers a portion of the rigid frame when the liner is secured to the rigid frame, and wherein the external heel of the rigid frame remains uncovered by the cover.

4. The boot of claim 3, further comprising a pad interposed between an inner surface of the rigid frame and the cover.

5. The boot of claim 3, wherein the rigid frame is attached to a chassis of a sports item.

6. The boot of claim 5, wherein the sports item comprises a skate.

7. The boot of claim 5, wherein the rigid frame is disposed between the liner and the chassis of the sports item.

8. The boot of claim 3, wherein the rigid frame is adapted to be attached to a plurality of different chassis of sports items.

9. The boot of claim 3, wherein the cover secures the liner to the rigid frame via the side fastening edges.

10. The boot of claim 3, wherein the rigid frame further comprises a collar portion connected to the reinforcing wall, the collar portion being disposed adjacent an ankle area of a user.

11. The boot of claim 10, wherein the collar portion is connected to the reinforcing wall so as to be flexible in at least one direction.

12. The boot of claim 11, wherein the at least one direction comprises a longitudinal direction.

13. The boot of claim 11, wherein the cover comprises at least one bending zone disposed at a height of an ankle of a user, the at least one bending zone comprising an elastic portion.

14. The boot of claim 11, wherein the collar position of the rigid frame is flexible in the transverse direction of the boot.

15. The boot of claim 11, wherein the collar portion is connected to the rigid frame via a journal.

16. The boot of claim 11, wherein the collar portion is connected to the rigid frame via elastically deformable zones.

17. The boot of claim 3, wherein the cover is connected externally to the rigid frame beneath a lower portion of the at least partially rigid sole.

18. A boot comprising:

a liner comprising a sole and an upper extending upwardly from the sole adjacent a heel area of the liner, at least a part of the upper being flexible;

a rigid frame adapted to receive the liner, the rigid frame comprising at least a partially rigid sole having having an external heel and a reinforcing wall extending upwardly from the at least partially rigid sole, the rigid frame being adapted to cover a portion of the upper adjacent the heel area of the liner; and a cover comprising an upper portion affixed to the liner and side fastening edges, the cover surrounding at least a portion of the liner, the cover and the liner being spaced apart and defining an opening adjacent the sole of the liner so as to receive the portion of the rigid frame;

wherein the cover covers a portion of the rigid frame when the liner is secured to the rigid frame, wherein the side fastening edges are affixed to the rigid frame at least partially rigid sole, and wherein the external heel of the rigid frame remains uncovered by the cover.

19. A boot comprising:

a liner comprising a sole and an upper extending upwardly from the sole adjacent a heel area of the liner, at least a part of the upper being flexible;

a rigid frame adapted to receive the liner, the rigid frame comprising at least a partially rigid sole having an external heel and a reinforcing wall extending upwardly from the at least partially rigid sole, the rigid frame being adapted to cover a portion of the upper adjacent the heel area of the liner; and a cover comprising an upper portion affixed to the liner and side fastening edges, the cover surrounding at least a portion of the liner, the cover and the liner being spaced apart and defining an opening adjacent the sole of the liner so as to receive the portion of the rigid frame;

wherein the cover covers a portion of the rigid frame when the liner is secured to the rigid frame, wherein the side fastening edges are directly affixed to the rigid frame in an area of the at least partially rigid sole, and wherein the external heel of the rigid frame remains uncovered by the cover.

20. A boot comprising:

a liner comprising a sole and an upper extending upwardly from the sole adjacent a heel area of the liner, at least a part of the upper being flexible;

a rigid frame comprising at least a partially rigid sole having an external heel and being at least partially external;

the rigid frame further comprising a reinforcing wall extending upwardly from the at least partially rigid sole, the rigid frame being adapted to receive the liner and adapted to cover a portion of the upper adjacent the heel area of the liner; and a cover surrounding at least a portion of the liner and being affixed to the liner, the cover and the liner being spaced apart and defining an opening adjacent the sole of the liner so as to receive the portion of the rigid frame;

wherein the cover covers a portion of the rigid frame when the liner is secured to the rigid frame, and wherein the external heel of the rigid frame remains uncovered by the cover.

* * * * *